US011697076B2

(12) United States Patent
Garland

(10) Patent No.: US 11,697,076 B2
(45) Date of Patent: Jul. 11, 2023

(54) SYSTEMS, METHODS, AND APPARATUSES FOR IMPLEMENTING MULTI-POINT CONTROLS FOR A GAS FLAME APPARATUS WITH A VARIABLE POSITION GAS FLAME TRIGGER

(71) Applicant: Tyler's Prop Shop, LLC, Beaverton, OR (US)

(72) Inventor: Tyler Garland, Beaverton, OR (US)

(73) Assignee: Tyler's Prop Shop LLC, Beaverton, OR (US)

( * ) Notice: Subject to any disclaimer, the term of this patent is extended or adjusted under 35 U.S.C. 154(b) by 301 days.

(21) Appl. No.: 17/124,044

(22) Filed: Dec. 16, 2020

(65) Prior Publication Data

US 2022/0072444 A1 Mar. 10, 2022

Related U.S. Application Data

(60) Provisional application No. 63/075,016, filed on Sep. 4, 2020.

(51) Int. Cl.
*A63J 5/02* (2006.01)
*F23Q 2/28* (2006.01)

(52) U.S. Cl.
CPC ..... *A63J 5/023* (2013.01); *F23Q 2/285* (2013.01)

(58) Field of Classification Search
CPC ..... A63J 5/023; F23Q 2/282; F23Q 2/285; F23Q 2/167
See application file for complete search history.

(56) References Cited

U.S. PATENT DOCUMENTS 2,666,480 A * 1/1954 Peterson ..... F23D 91/02 431/255
2,676,698 A * 4/1954 Pauly ..... A24F 15/18 206/88

(Continued)

*Primary Examiner* — Alfred Basichas
(74) *Attorney, Agent, or Firm* — Elliott, Ostrander & Preston, P.C.

(57) ABSTRACT

Systems, methods, and apparatuses for implementing multi-point controls for a gas flame apparatus with a variable position gas flame trigger are described herein. For example, according to one embodiment there is a novelty apparatus including: a frame, in which the frame is comprised of a top frame resting upon a bottom frame; an output nozzle anterior to the frame; a tactical stock posterior to the frame; a tank mount attached to the frame to receive a fuel source tank; a gas line to feed gas from the fuel source tank into a gas inlet of the novelty apparatus; a grip affixed to the frame; a flame output system housed within the frame, in which the flame output system includes at least (i) the gas inlet to receive the gas line, (ii) a variable control plunger, (iii) a 4-way connector, (iv) a gas outlet, (v) a gas hard-line, and (vi) a burner tube; a trigger housed in the frame connected to the variable control plunger, in which pressing on the trigger releases the plunger to feed gas into the gas inlet from the gas line; an ignition system, wherein the ignition system includes at least (i) an igniter button, (ii) an igniter, (iii) igniter coils, and (iv) an igniter wire; a pre-set multi-point control system for flame management having a primary valve, an idle control valve and an igniter, in which pre-settings on the primary valve restrict tank flow; in which adjusting the pre-settings on the multi-point control system maintains an idle flame having a size that does not extinguish when the trigger releases the plunger and a pre-set increment of tank flow is released, transiting the idle flow to reach the burner tube; a structural reinforcement mount internal to the frame to provide rigidity and receive the tactical stock; and in which manipulation of the multi-point control system in coordina- (Continued)

tion with the flame output system and ignition system results in the emission and maintenance of a flame. Other related embodiments are disclosed.

1 Claim, 24 Drawing Sheets

(56) References Cited

U.S. PATENT DOCUMENTS

| | | | | | |
|---|---|---|---|---|---|
| 3,406,001 | A * | 10/1968 | Ishibashi | F23Q 2/282 | 431/255 |
| 3,520,647 | A * | 7/1970 | Albertus | F23Q 1/02 | 431/275 |
| 4,315,731 | A * | 2/1982 | Moore | F23Q 2/32 | D7/416 |
| 4,352,658 | A * | 10/1982 | Racek | F23Q 2/161 | D7/416 |
| 5,020,989 | A * | 6/1991 | Liu | F23Q 2/32 | 431/255 |
| 6,343,928 | B1 * | 2/2002 | Liang | F23Q 2/285 | 431/153 |
| 7,681,351 | B2 * | 3/2010 | Bucholtz | F41C 23/06 | 42/1.06 |
| 8,834,152 | B1 * | 9/2014 | Calvert | F41C 27/00 | 431/91 |
| 2015/0226430 | A1 * | 8/2015 | Wiles | F23Q 2/285 | 431/6 |
| 2019/0346138 | A1 * | 11/2019 | Bernick | F23Q 2/285 | |

* cited by examiner

2300

SYSTEMS, METHODS, AND APPARATUSES FOR IMPLEMENTING MULTI-POINT CONTROLS FOR A GAS FLAME APPARATUS WITH A VARIABLE POSITION GAS FLAME TRIGGER

CLAIM OF PRIORITY

The present application is related to, and claims priority to, U.S. Provisional Patent Application Ser. No. 63/075,016, filed Sep. 4, 2020, entitled "SYSTEMS, METHODS, AND APPARATUSES FOR IMPLEMENTING MULTI-POINT CONTROLS FOR A GAS FLAME APPARATUS WITH A VARIABLE POSITION GAS FLAME TRIGGER," the entire contents of which are incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

Embodiments disclosed herein relate generally to the field of fuel-burning tools and novelty apparatuses. More particularly, disclosed embodiments relate to systems, methods, and apparatuses for implementing multi-point controls for a gas flame apparatus with a variable position gas flame trigger.

BACKGROUND

The subject matter discussed in the background section is not to be considered prior art merely because of its mention in the background section. Similarly, a problem mentioned in the background section or associated with the subject matter of the background section shall not be considered to have been previously recognized in the prior art. The subject matter in the background section merely represents different approaches, which in and of themselves, may also correspond to claimed embodiments.

Innovative props and devices long depicted in films and other media have found a market among lay consumers desiring novelties and prop replicas at affordable prices for fire display and amusement. Specialized gadgets and devices such as flamethrowers that pop culture fans may see in the movies however are not readily available to consumers for several reasons. Firstly, they are often classified as weapons that shoot ammunitions or flames far distances. Secondly, they require sensitive and dangerous materials to operate, such as pressurized gelled gas, which may explode, easily stick to objects as well as being dangerous to contain and store. Furthermore, the process of creating such devices involves lengthy experimentation, reverse engineering and modification of commercially available substitute components which are often unsuitable or ineffective for purposes of creating functional devices that emulate the props and devices that captivate pop culture fans on the big and small screen.

Problematically, many layperson adults who are novelty apparatus and film prop enthusiasts would like to own a device such as those depicted in films as blowtorches and machine guns, but one that is not a mere prop nor classified as a weapon. Fire weapons such as flamethrowers are typically available to military and special forces, require special licenses, and can be prohibitively expensive for most private individuals to own. Rather such consumers desire a functional flame apparatus that does not require the use of special effects or complicated engineering, and can be controlled by the user. Previous methods of devices involving flame production involve complex or prone to fault ignition systems or poor flame maintenance without idle flame control such that flames are easily snuffed out when trigger mechanisms are activated.

A device with variable flame control is thus described herein which may be utilized as a display novelty for demonstrating various flame sizes and flame bursts, yet is not intended for use as a weapon or as a toy for children. Nor does the device with variable flame control described herein pose the dangers inherent with components such as gelled gasoline used in flamethrowers which can cause burns and serious bodily harm to the user, others or property, even when operated by an experienced user. Beneficially, the novelty apparatus described herein largely avoids such dangers and the cumbersome requirements involved in operating and maintaining weapons-grade apparatuses by using propane gas which is much safer to use and to contain. Such a novelty apparatus, however, is notably distinct from a flamethrower or firearm due to its multi-point control mechanism for maintaining a flame that does not quickly snuff out when the trigger mechanism is activated. Furthermore, the multi-point control system allows for controlling the size of the flame, producing a safer maximum flame size or target range which is far less than flamethrowers or fire weapons. Interestingly, the novelty apparatus described herein has uses beyond novelty and display and may be used to heat objects such as pipes, burn weeds, or quickly cook items such as hot dogs in a controlled fashion.

The present state of the art may therefore benefit from the systems, methods, and apparatuses for implementing multi-point controls for a gas flame apparatus with a variable position gas flame trigger as is described herein.

BRIEF DESCRIPTION OF THE DRAWINGS

Embodiments are illustrated by way of example, and not by way of limitation, and will be more fully understood with reference to the following detailed description when considered in connection with the figures in which.

DETAILED DESCRIPTION

Figure 1:
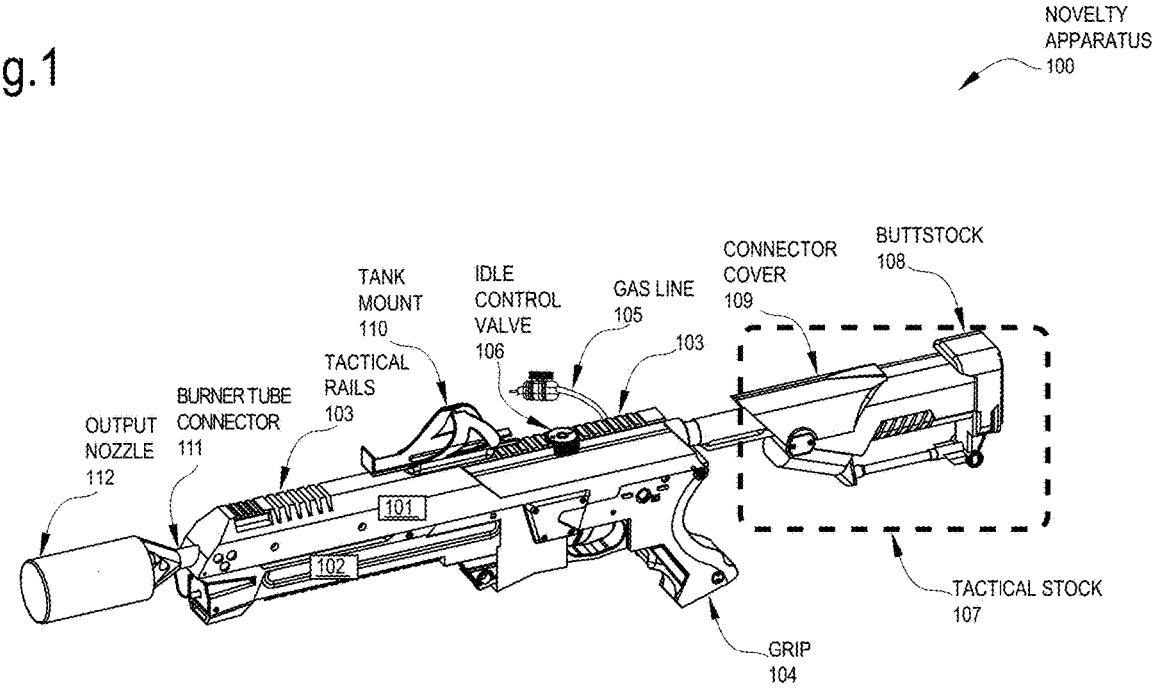
FIG. 1 depicts an exemplary architecture device with variable position flame control including at least a frame, gas line and burner tube, in accordance with described embodiments.

Described herein are systems, methods, and apparatuses for implementing multi-point controls for a gas flame apparatus with a variable position gas flame trigger.

For instance, according to a particular embodiment, there are systems, methods, and apparatuses for implementing multi-point controls for a gas flame apparatus with a variable position gas flame trigger. For example, according to one embodiment there is a novelty apparatus including: a frame, in which the frame is comprised of a top frame resting upon a bottom frame; an output nozzle anterior to the frame; a tactical stock posterior to the frame; a tank mount attached to the frame to receive a fuel source tank; a gas line to feed gas from the fuel source tank into a gas inlet of the novelty apparatus; a grip affixed to the frame; a flame output system housed within the frame, in which the flame output system includes at least (i) the gas inlet to receive the gas line, (ii) a variable control plunger, (iii) a 4-way connector, (iv) a gas outlet, (v) a gas hard-line, and (vi) a burner tube; a trigger housed in the frame connected to the variable control plunger, in which pressing on the trigger releases the plunger to feed gas into the gas inlet from the gas line; an ignition system, wherein the ignition system includes at least (i) an igniter button, (ii) an igniter, (iii) igniter coils, and (iv) an igniter wire; a pre-set multi-point control system for flame management having a primary valve, an idle control valve and an igniter, in which pre-settings on the primary valve adjust tank flow at 25%, 50%, 75% and 100% increments, in which pre-settings on the idle control valve adjust idle flow at 25%, 50%, 75% and 100% increments, to restrict tank flow; in which adjusting the pre-settings on the multi-point control system maintains an idle flame having a size that does not extinguish when the trigger releases the plunger and a pre-set increment of tank flow is released, transiting the idle flow to reach the burner tube; a structural reinforcement mount internal to the frame to provide rigidity and receive the tactical stock; and in which manipulation of the multi-point control system in coordination with the flame output system and ignition system results in the emission and maintenance of a flame. Other related embodiments are disclosed.

In addition to a multi-point control system, the novelty apparatus provides for positional flame manipulation. After a desired idle flame is achieved, users may pivot the novelty apparatus in various positions to manipulate flame length while activating a trigger to emit flame bursts from the novelty apparatus. Holding the novelty apparatus downwards from 0 degrees horizontally (−315 degrees) produces a smaller flame size as aerosol gas enters the flame output system first in this position while liquid pressurized gas is tipped away from the fuel source tank. In contrast, pointing the novelty apparatus at 45 degrees upwards from 0 degrees horizontal allows for pressurized liquid gas to reach the flame output system first, producing a flame burst of up to approximately 6 feet depending on the pre-settings used for the primary valve and idle valve control.

In the following description, numerous specific details are set forth such as examples of specific configurations, use cases, materials, components, etc., in order to provide a thorough understanding of the various embodiments. It will be apparent, however, to one skilled in the art that these specific details need not be employed to practice the embodiments disclosed herein. In other instances, well-known materials or methods have not been described in detail in order to avoid unnecessarily obscuring the disclosed embodiments.

In addition to various hardware components depicted in the figures and described herein, embodiments further include various operations described below. The operations described in accordance with such embodiments may be performed by specially manufactured components or may utilize general-purpose components in certain instances to realize and perform the innovative function and configuration of the described embodiments. Alternatively, the operations may be performed by a combination of customized specially manufactured components with certain general purpose components to make, use, and practice the inventive aspects as set forth herein.

FIG. 1 depicts an exemplary architecture device with variable position flame control including at least a frame, gas line and burner tube, in accordance with described embodiments.

Specifically, a device for variable position flame control, also known as novelty apparatus 100 is comprised of a top frame 101 resting on bottom frame 102. Tactical rails 103 may be mounted on top of top frame 101 and/or on bottom of bottom frame 102 and allow for attachment of accessories and enhancements to novelty apparatus 100 such as sights, lasers, flashlights, etc. In other embodiments, such accessories and enhancements may be attached directly to top frame 101 or bottom frame 102 via integrated Picatinny rails. Grip 104 allows the user to hold onto the apparatus with their hands. In other embodiments, placement of additional grips is possible for added hand-held support such as a foregrip. Tactical stock 107 provided additional support and stability by, for example, resting on the user's shoulder. In certain embodiments, the length of tactical stock 107 may be adjustable. Tactical stock 107 is attached to the rest of novelty apparatus 100 and is secured via connector cover 109. Buttstock 108 allows for further control and stability, as, for example, the user may hold onto buttstock 108 to position and stabilize novelty apparatus 100. A fuel source tank, such as a propane tank, may be secured to novelty apparatus 100 via tank mount 110. The fuel source tank may connect to gas line 105. Gas line 105 may be constructed of various material including various woven or textile braids formed from a variety of materials including, for example, plastics or other synthetics, stainless steel, etc. As shown here, the gas line 105 has an anterior portion comprising a crimp and a barb for receiving the fuel source tank. The flow of gas through novelty apparatus 100 may be controlled by idle control valve 106. Idle control valve 106 lets a fixed amount of gas through at a fixed rate and may be adjust to reach an idle level to create idle flame. Gas exits novelty apparatus 100 via burner tube connector 111 which is connected to output nozzle 112.

Figure 2:
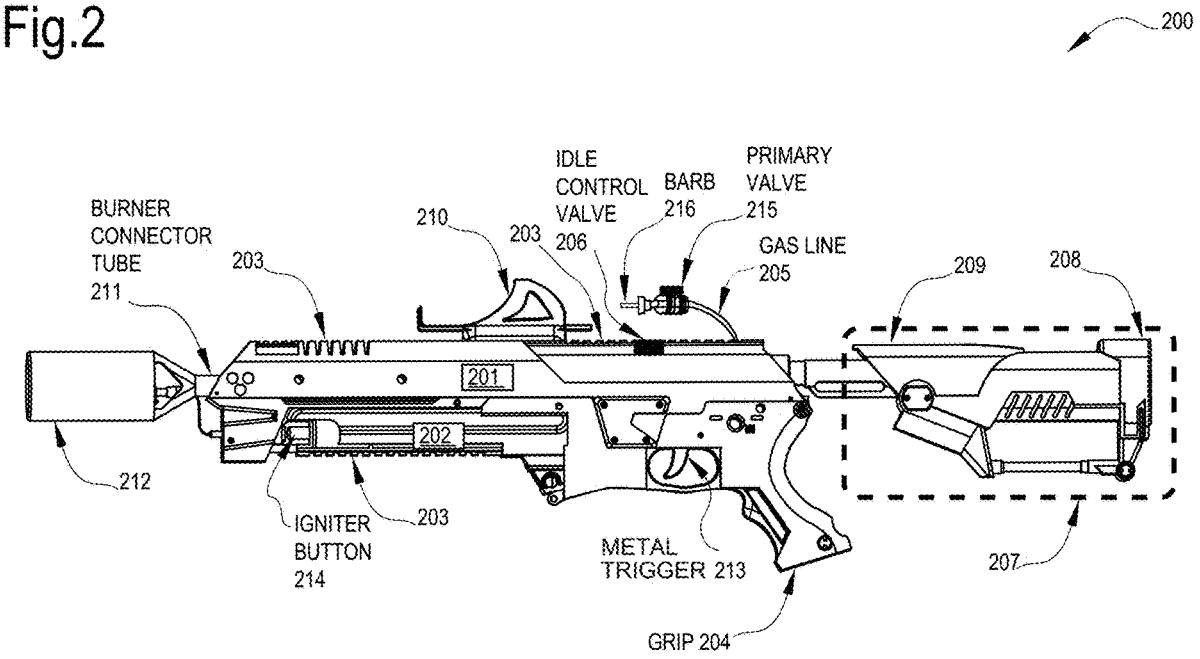
FIG. 2 depicts a side view of a device with variable position flame control, in accordance with described embodiments.

FIG. 2 depicts a side view of a device with variable position flame control, in accordance with described embodiments.

Specifically, a device for variable position flame control, also known as novelty apparatus 200 is comprised of a top frame 201 resting on bottom frame 202. Tactical rails 203 may be mounted on top of top frame 201 and/or on bottom of bottom frame 202 and allow for attachment of accessories and enhancements to novelty apparatus 200 such as sights, lasers, flashlights, etc. In other embodiments, such accessories and enhancements may be attached directly to top frame 201 or bottom frame 202 via integrated Picatinny rails. A fuel source tank, such as a propane tank, may be secured to novelty apparatus 200 via tank mount 210. The fuel source tank may connect to gas line 205 via barb 216. Primary valve 215 is part of the multi-point control system for novelty apparatus 200 and may be adjusted to allow the flow of gas from a fuel source tank into gas line 205. Once gas flows into novelty apparatus 200, igniter button 214 may be pressed to activate an ignition system, allowing for a spark to emit a flame from novelty apparatus 200 through burner tube connector 211 and out from output nozzle 212. Idle control valve 206 is also part of the multi-point control system and allows for adjustment and maintenance of a desired flow of gas through novelty apparatus 200 to keep a flame lit and prevent snuffing out of an achieved flame once the metal trigger 213 is activated to further modify flame size and bursts. Gas exits novelty apparatus 100 via burner tube connector 211 which is connected to output nozzle 112. Importantly, idle control valve 206 and primary valve 215 also function as safety mechanisms, allowing for control of the flame emitted by closing or partially closing one or more of these valves to control flame size or to snuff out the flame when needed to prevent injury or damage.

In front of grip 204 rests metal trigger 213. The metal trigger 213 may be activated and allows for bursts of gas through gas inlet 1223 of novelty apparatus 200, which creates flame bursts which can impress viewers during fire display and amusement. According to the described embodiments, the metal trigger 213 may be comprised of various materials such as brass, aluminum, stainless steel, metallic alloys, hardened plastics, composites, etc. Thus, while a strengthened metallic trigger is preferred and disclosed, other materials may be utilized.

If idle control valve 206 is not sufficiently open, the flame created will blow out when trigger 213 is pulled. Pre-settings on idle control valve 206 help to prevent this by keeping a sufficient idle flow of 25%, 50%, 75% or 100%. Idle control valve 206 is essential to produce a flame when the trigger is pulled as primary valve 215 cannot accomplish an idle flame without being regulated by idle control valve 206.

Figure 3:
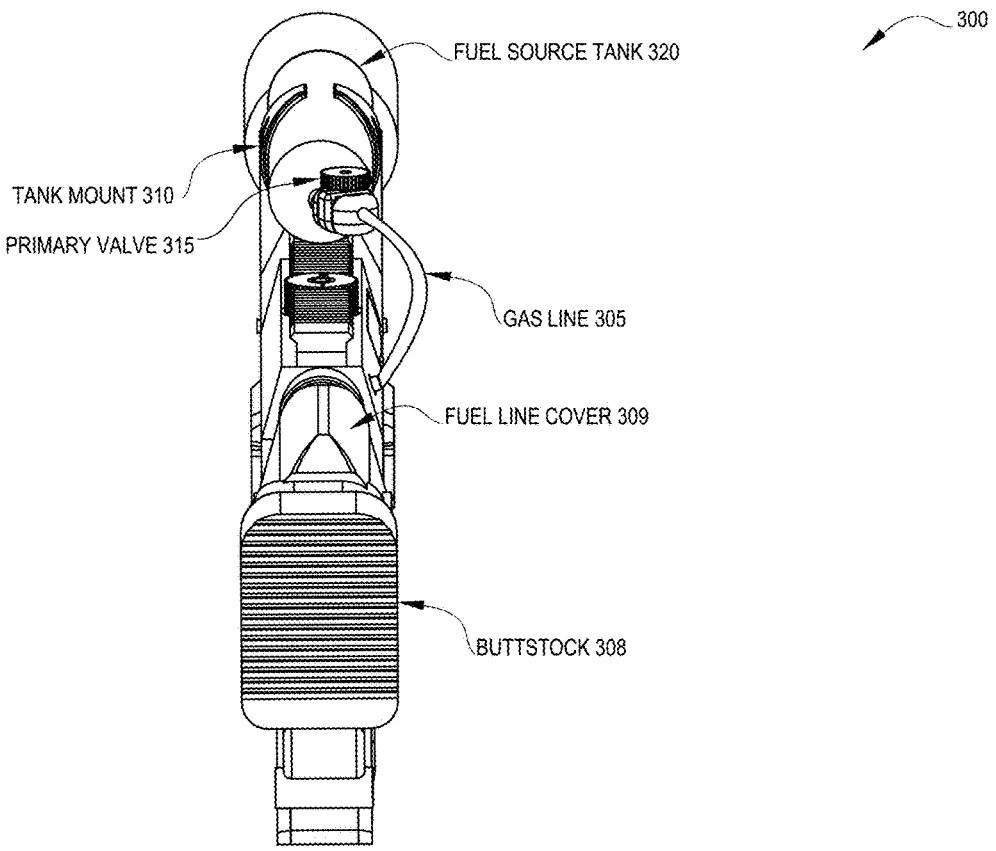
FIG. 3 depicts a posterior view of a device with variable position flame control, in accordance with described embodiments.

FIG. 3 depicts a posterior view of a device with variable position flame control, in accordance with described embodiments.

Specifically, ridges on buttstock 308 allow for enhanced grip. Also seen is fuel line cover 309, which protects and covers the fuel line and valves positioned internal to the apparatus. A fuel source tank 320 may be supported on top of the device by being mounted onto tank mount 310, allowing for stable connection to gas line 305. Commencement and adjustment of gas from a fuel source tank may be controlled via primary valve 315.

Figure 4:
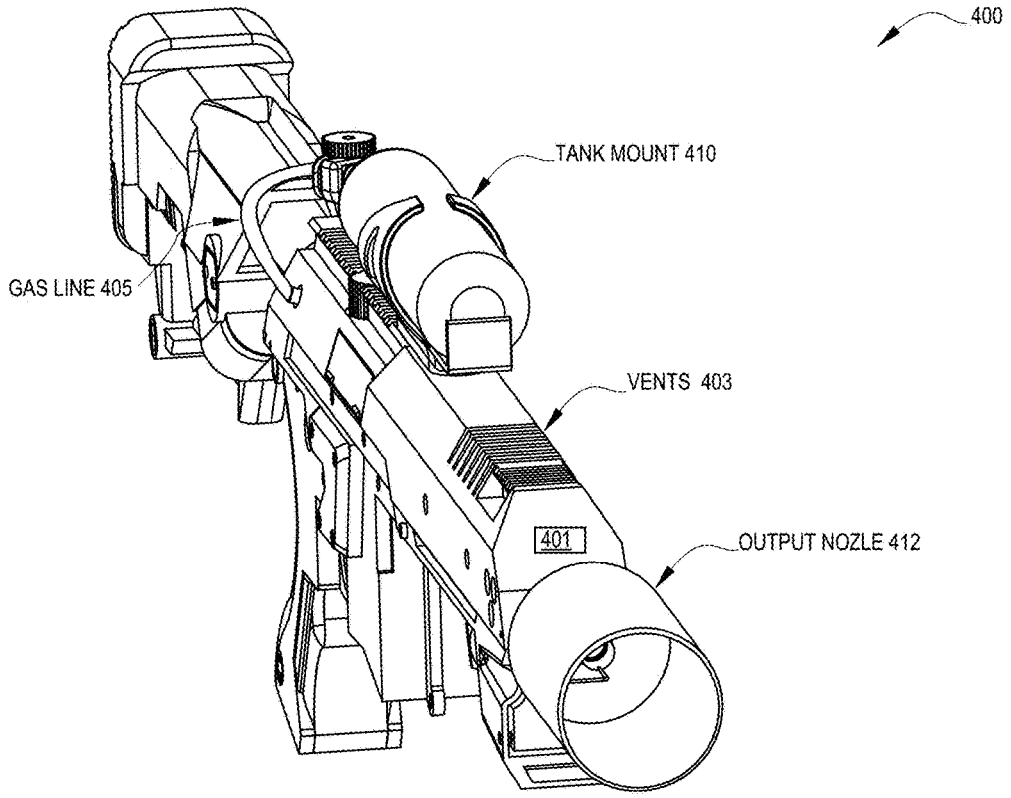
FIG. 4 depicts an anterior perspective view of a device with variable position flame control, in accordance with described embodiments.

FIG. 4 depicts an anterior perspective view of a device with variable position flame control, in accordance with described embodiments.

Specifically, a closer view of output nozzle 412 is seen. Flame emissions exit the device through output nozzle 412, which is attached to top frame 401. There are further depicted on the top front position of the apparatus a series of vents 403 which are configured to promote cooling of the apparatus while in use. Oriented to the right of tank mount 410 is gas line 405.

Figure 5:
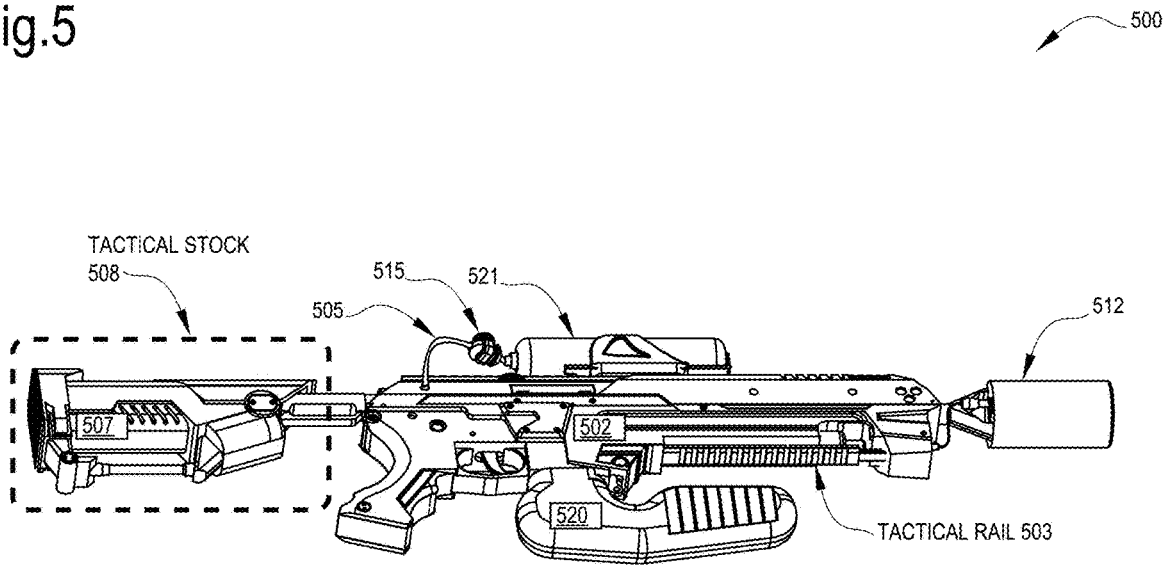
FIG. 5 depicts an inferior perspective view of a device with variable position flame control, in accordance with described embodiments.

FIG. 5 depicts an inferior perspective view of a device with variable position flame control, in accordance with described embodiments.

Highlighted are tactical rail 503, which allows for hanging and mounting of various accessories such as additional tank mounts, flashlights, lasers, etc. Tactical rail 503 is connected to bottom frame 502 and may be divided into non-contiguous various segments along this plane. The bottom 507 of tactical stock 508 is also seen which may rest on a user's shoulder.

Figure 6:
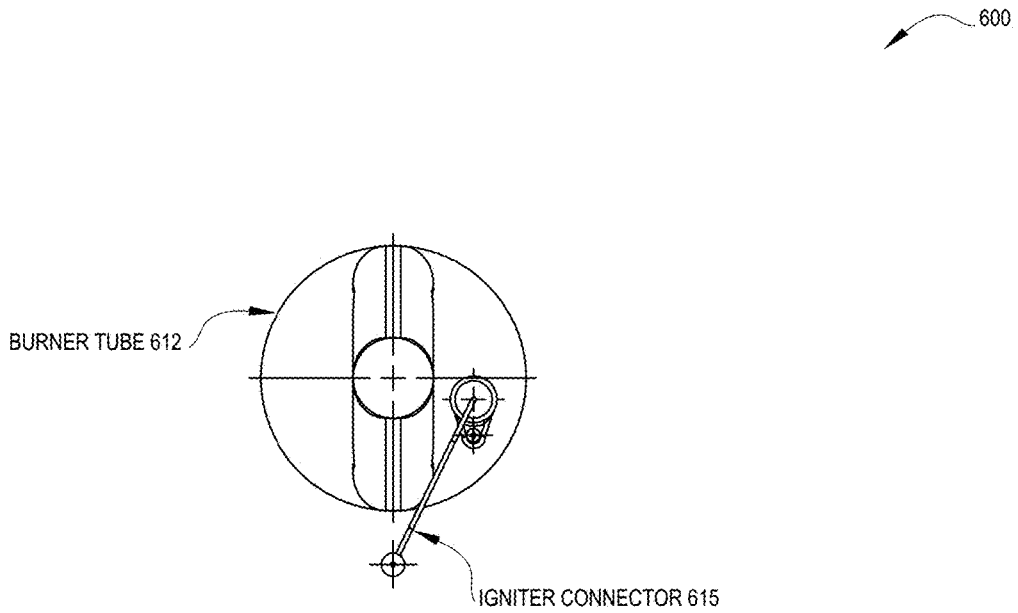
FIG. 6 depicts an exemplary architecture burner tube connector, in accordance with described embodiments.

FIG. 6 depicts an exemplary architecture burner tube connector, in accordance with described embodiments. Burner tube connector 612 may be metal and contains igniter connector 615, which may connect to igniters such as those in electronic and Piezo ignition systems 1800.

Figure 7:
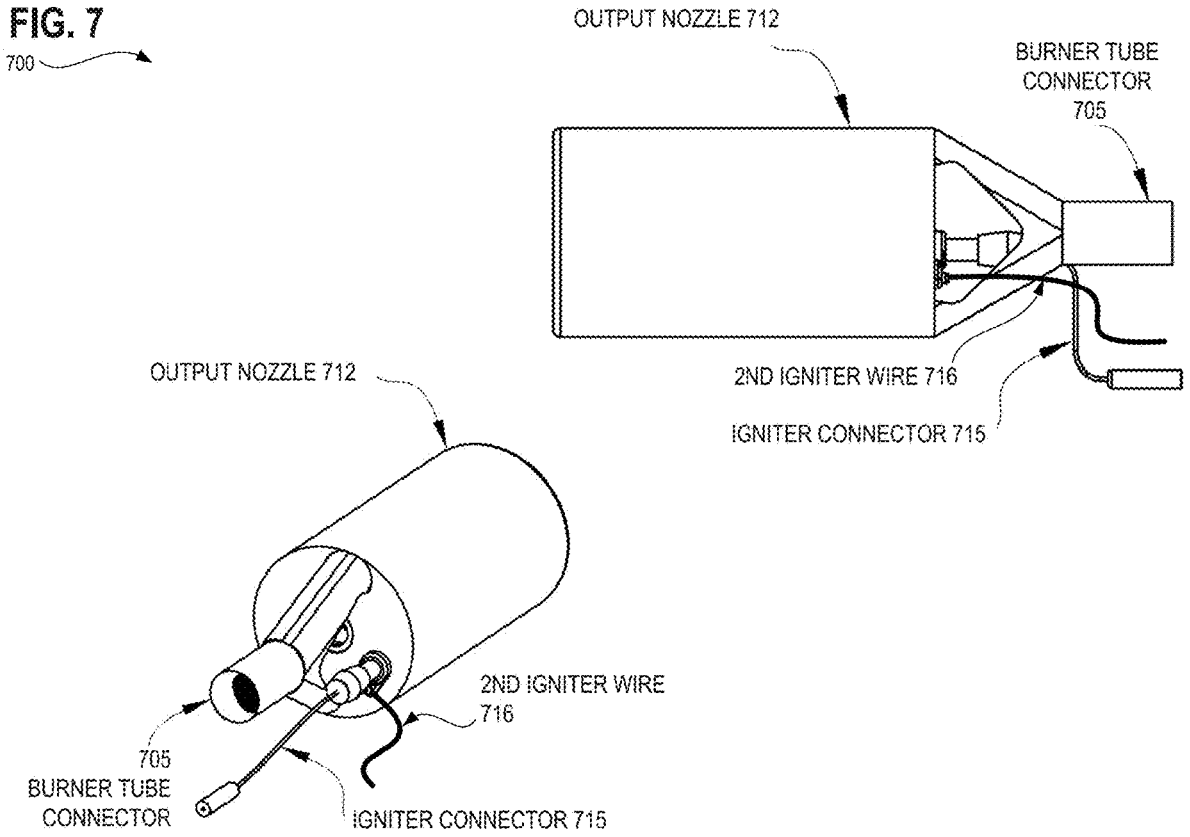
FIG. 7 depicts an exemplary architecture output nozzle connected to a burner tube connector, in accordance with described embodiments.

FIG. 7 depicts an exemplary architecture output nozzle connected to a burner tube connector, in accordance with described embodiments. Here, burner tube connector 705 connects to output nozzle 712. Posteriorly, burner tube connector 705 connects to burner tube connector 111. Each of igniter connector 715 and second (2nd) igniter wire 716 are further depicted, thus permitting the igniter of the apparatus to be connected and configured with either electronic or Piezo ignition systems 1800, such as those depicted at FIG. 18.

Figure 8:
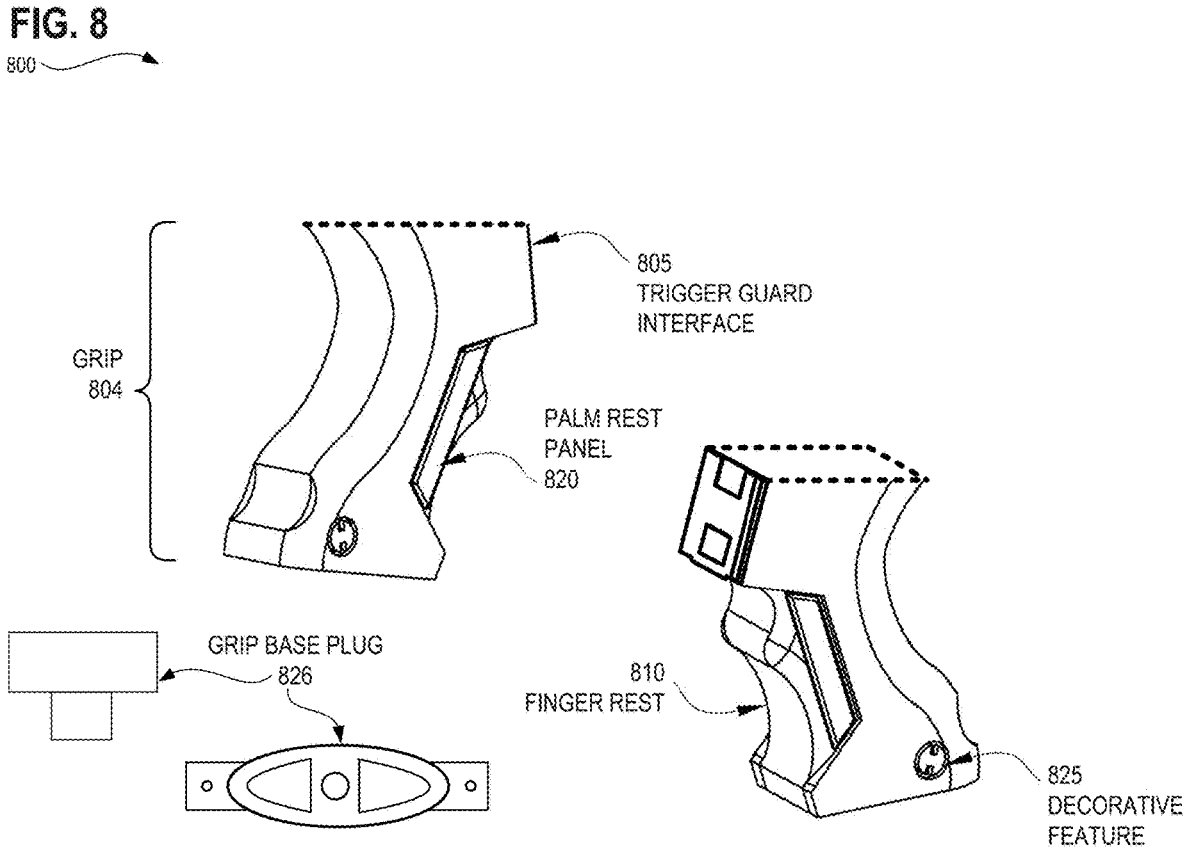
FIG. 8 depicts an exemplary architecture grip, in accordance with described embodiments.

FIG. 8 depicts an exemplary architecture grip, in accordance with described embodiments.

Various perspective views 800 of grip 804 are shown. Grip 804 allows for user control of the novelty apparatus 100 similar to the grip on a handgun. Grip 804 may be placed in various and multiple positions along novelty apparatus 100 and may function, for example as a foregrip. Palm rest panel 820 allows for users to rest the upper portion of their palms and metacarpophalangeal joints (knuckles) while using grip 804. Similarly, finger rest 810 allows users to rest their fingers and stabilize their hand as they use grip 804 and activate trigger 213. Grip 804 connects to trigger guard 917 of bottom frame 902 via trigger guard interface 805, interfacing posterior to trigger 213. Grip 804 is further connected and stabilized to the novelty apparatus via bottom frame connector 815, which attaches grip 804 to bottom frame 102, superior to trigger guard 917. Element 825 depicts a decorative features (e.g., such as a non-functional plug or fastener), though in other configurations, a functional plug or fastener could be utilized.

Still further depicted are both side and bottom views of the grip base plug 826 having fastener holes configurable to attach the grip base plug 826 into the bottom most portion of the trigger guard interface 805.

Figure 9:
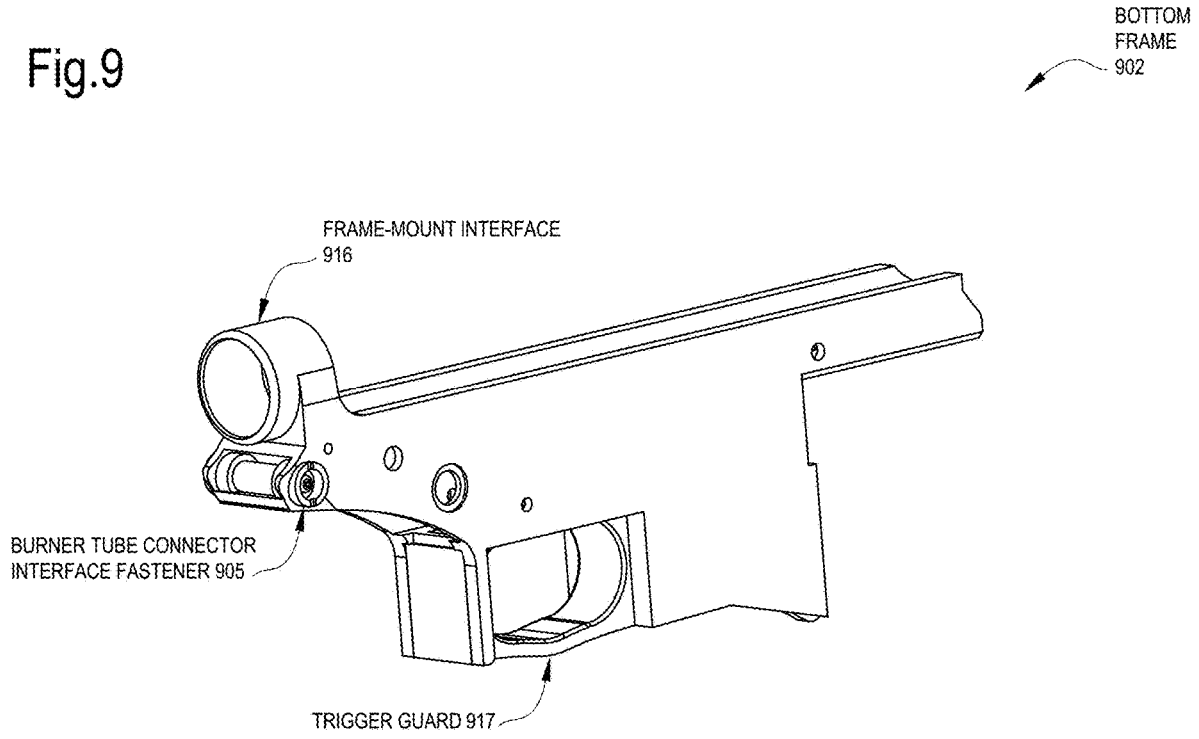
FIG. 9 depicts an exemplary bottom frame, in accordance with described embodiments.

FIG. 9 depicts an exemplary bottom frame, in accordance with described embodiments.

As shown here, bottom frame 902 contains trigger guard 917 which serves to house trigger 213 and to prevent accidental firing of the trigger as well as to support a user's fingers when activation of the trigger is desired or to rest a user's fingers between activation of the trigger to manipulate flame size and create flame bursts emanating from novelty apparatus 100 through output nozzle 112. Frame-mount interface 916 serves as a connection point between bottom frame 902 and top frame rail 1018 and components internal to top frame 101 such as flame output system 1200. Burner tube connector interface fastener 905 aids in securing the connection between bottom frame 902 and burner tube connector 111.

Figure 10:
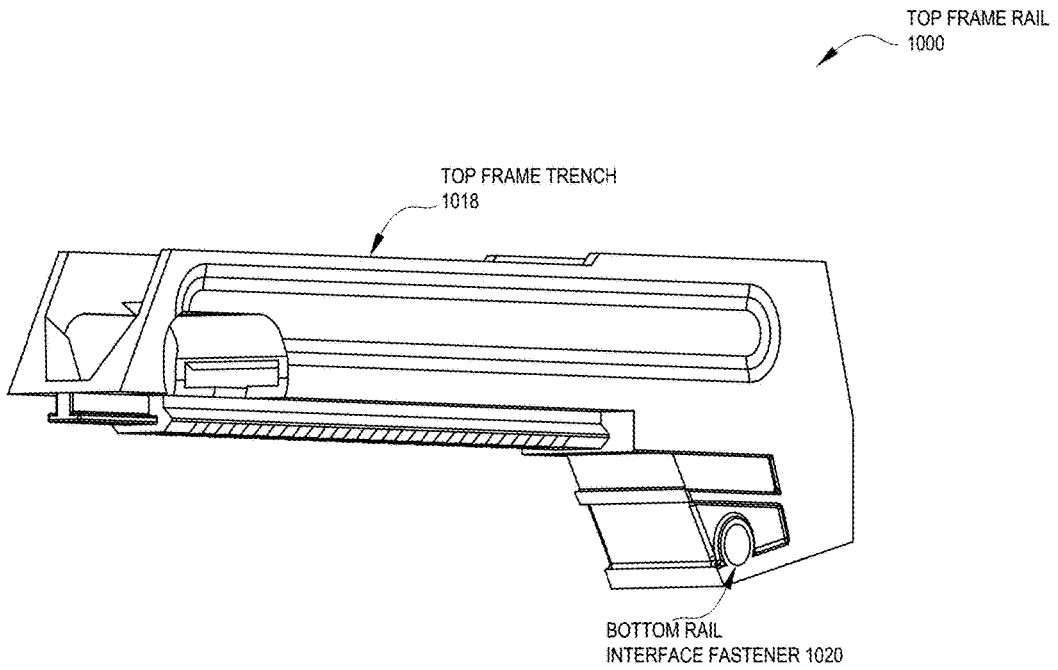
FIG. 10 depicts an exemplary top frame rail, in accordance with described embodiments.

FIG. 10 depicts an exemplary top frame rail, in accordance with described embodiments.

As shown here, top frame rail 1000 is shaped to rest on top of bottom frame 902. Top frame trench 1018 allows for housing of components internally such as flame output system 1200. Top frame rail 1000 is secured to bottom frame via bottom rail interface fastener 1020.

Figure 11:
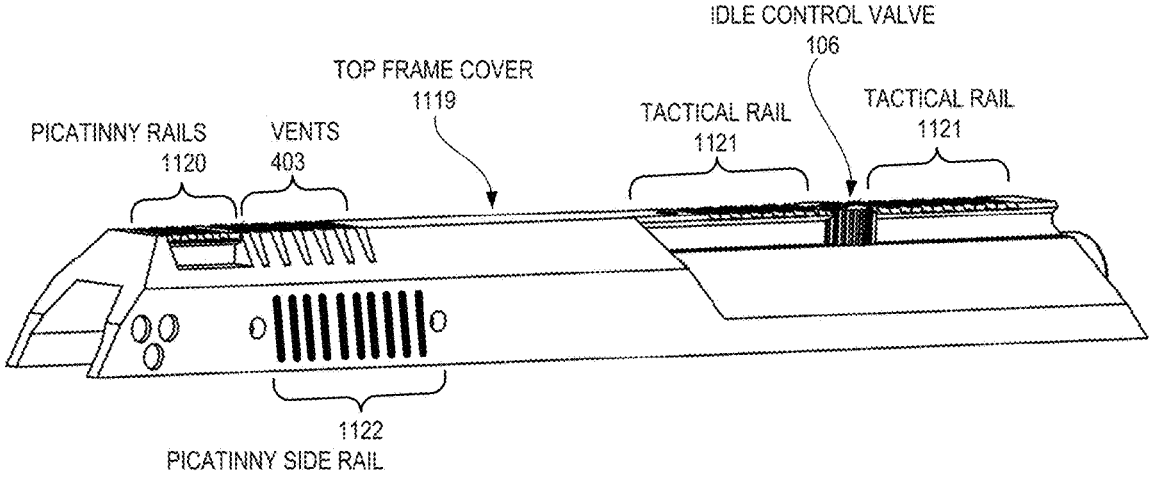
FIG. 11 depicts an exemplary top frame cover, in accordance with described embodiments.

FIG. 11 depicts an exemplary top frame cover, in accordance with described embodiments.

As shown here, top frame cover 1100 is an elongated cover meant to rest on top of top frame rail 1000 to complete the assembly of top frame 101. Top frame cover 1100 protects internal components of top frame 101 such as flame output system 1200. Furthermore, top frame cover 1100 has both Picatinny rails 1120 with grills anteriorly as well as tactical rails 1121 posteriorly with raised ridges for attachment of accessories such as flashlights, mounts, lasers, etc. The top of idle control valve 106 may protrude through tactical rail 103. According to certain embodiments, tank mount 110 may rest on the middle portion of top frame cover 1119.

The top frame cover 1119 as shown here may be configured with multiple distinct tactical type rails for mounting accessories, including tank mounts for gas tanks. For instance, as shown here, in addition to the picatinny rails 1120 shown at the front forward position of the top frame cover 1119, there are further the tactical rails 1121 shown near the back of the top frame cover 1119 and still further the picatinny side rail 1122 depicted on the forward side of the top frame cover 1119.

Figure 12:
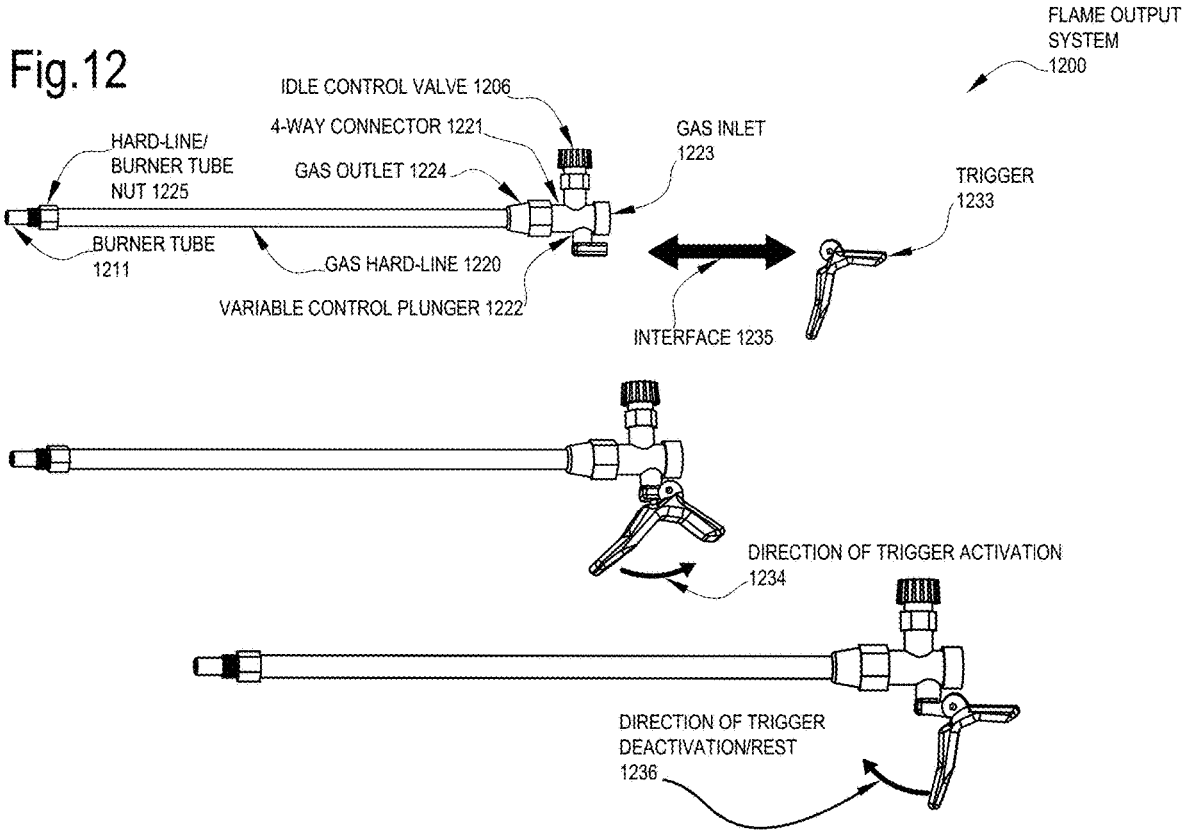
FIG. 12 depicts an exemplary flame output system, in accordance with described embodiments.

FIG. 12 depicts an exemplary flame output system, in accordance with described embodiments.

As shown here, flame output system 1200 is comprised of gas inlet 1223, 4-way connector 1221, variable control plunger 1222, gas outlet 1224, gas hard-line 1220, burner tube 1211 and idle control valve 1206. The process of flame output begins pursuant to the connection of a fuel source tank to barb 216 of primary valve 215. Upon opening of primary valve 215, gas flows from a fuel source gas through gas line 105 towards gas inlet 1223.

Variable control plunger 1222 may connect or interface with trigger 1233 to provide user control of flame output system 1200. Direction of trigger activation 1234 indicates trigger 1233 being pressed in the posterior direction of variable control plunger 1222. This causes gas inlet 1223 to open as activation of trigger 1233 pulls downwards on variable control plunger 1222 to raise variable control plunger 1222. With gas inlet 1223 open, gas passes through 4-way connector 1221, gas inlet 1223 and into gas hard-line 1220 via gas outlet 1224, ultimately exiting flame output system 1200 through burner tube 1211. Igniter button 214 lights a spark at burner tube 1211, igniting the transiting gas and producing flame via combustion, a redox chemical reaction between the gas and atmospheric oxygen. In certain embodiments, burner tube 1211 may be connected to output nozzle 712 via burner tube connector 705. Burner tube 1211 is secured to gas hard-line 1220 via gas hard-line/burner tube nut 1225.

To de-activate trigger 1233 and the resulting activation of flame output system 1200, a user may release trigger 1233, causing trigger 1233 to move in the direction of trigger deactivation/rest 1234, which lowers variable control plunger 1222, preventing gas from flowing towards burner tube 1211 where ignition occurs and flame emission begins.

Figure 13:
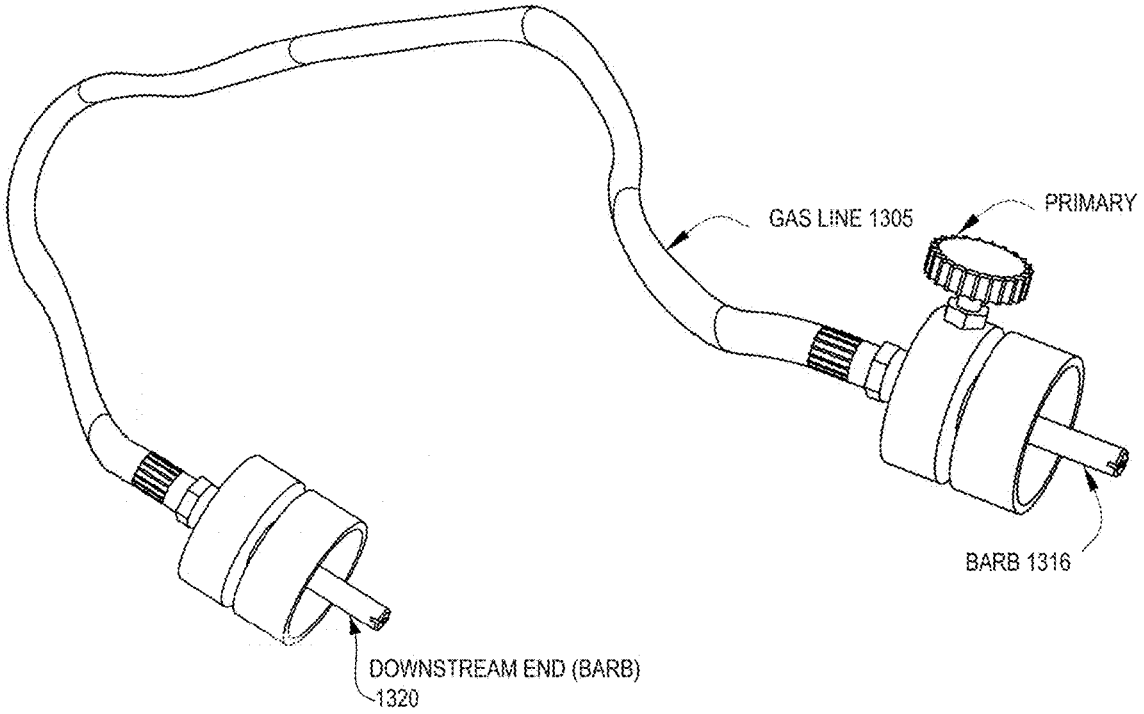
FIG. 13 depicts an exemplary gas line and associated components, in accordance with described embodiments.

FIG. 13 depicts an exemplary gas line and associated components, in accordance with described embodiments.

As shown here, gas line 1305 may be a coiled material with two ends. Barb 1316 of gas line 1305 connects to a fuel source tank. Upon opening of primary valve 1315, gas flows through barb 1316 into gas line 1305 which may be connected at its downstream end 1320 to gas inlet 1223.

Figure 14:
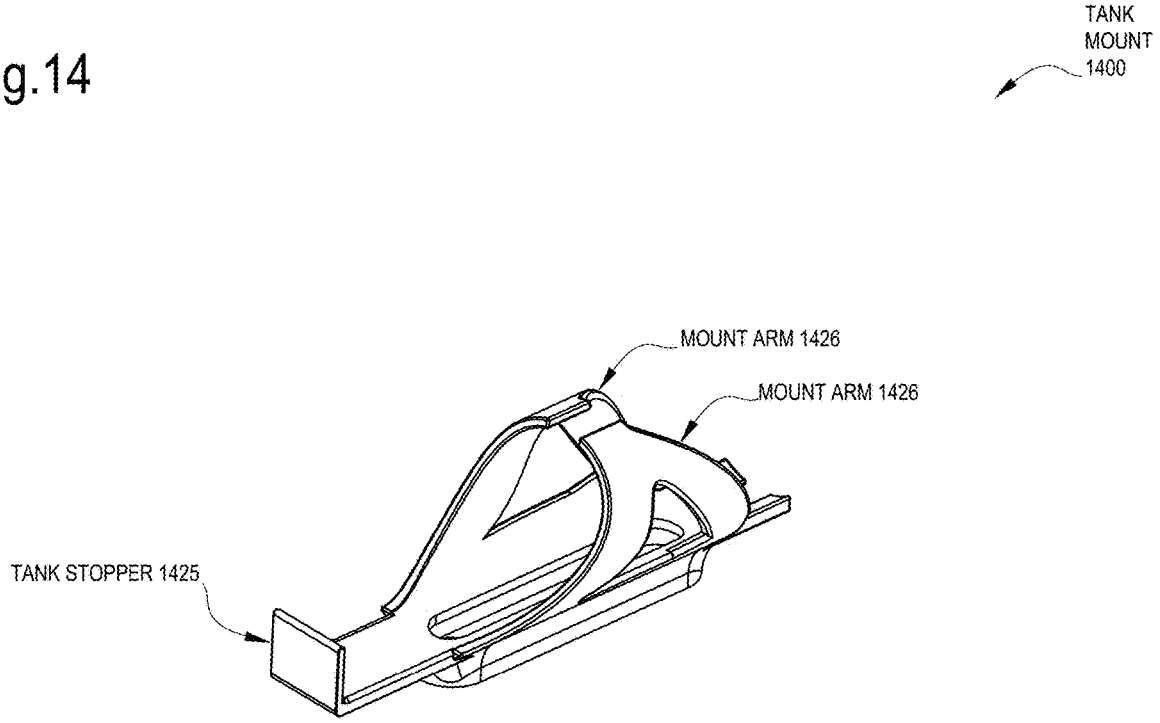
FIG. 14 depicts an exemplary tank mount, in accordance with described embodiments.

FIG. 14 depicts an exemplary tank mount, in accordance with described embodiments.

As shown here, according to certain embodiments, tank mount 1400 may be shaped similar to a water bottle mount found on bicycles. Mount arms 1426 wrap around an inserted fuel source tank and snugly hold such a tank. Tank stopper 1425 prevents a fuel source tank from sliding forward and further stabilizes a fuel source tank as novelty apparatus 100 is manipulated into different positions by a user.

Figure 15:
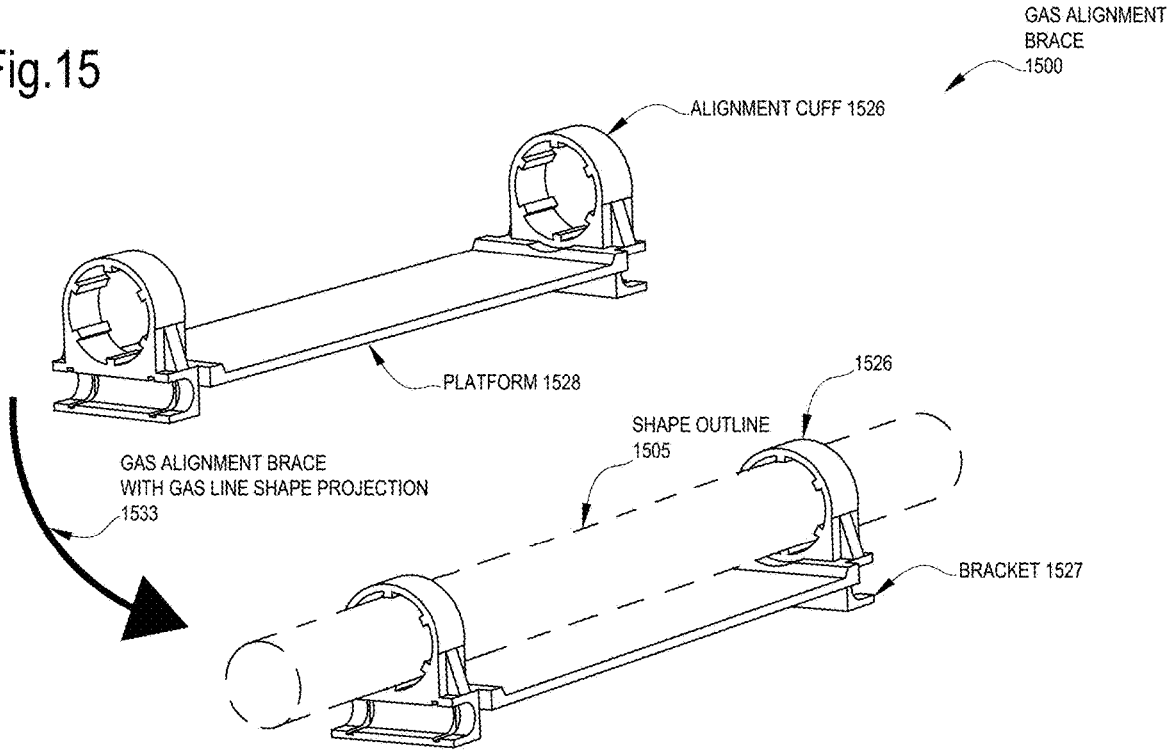
FIG. 15 depicts an exemplary gas alignment brace, in accordance with described embodiments.

FIG. 15 depicts an exemplary gas alignment brace, in accordance with described embodiments.

In contrast to firearms with sturdy metal barrels for aligning and stabilizing ammunition during ejection, novelty apparatus 100 lacks such a container as the novelty apparatus is designed for flame emission and not for shooting bullets.

To solve the problem of gas lines such as gas line 105 and other components of novelty apparatus 100 such as flame output system 1200 from shifting and becoming blocked, gas alignment brace 1500 is introduced to stabilize and align gas lines as they pass through top frame 101, connecting downstream to flame output system 1200.

Gas alignment brace 1500 includes alignment cuffs 1526 and platform 1528. Gas alignment brace with gas line shape projection 1533 shows the shape outline 1505 of gas line 105 when gas line 105 is fitted to gas alignment brace 1500. The shape outline 1505 of gas line 105 runs parallel to and on top of platform 1528 and passes through alignment cuffs 1526, which allows for self-centering and stabilizing of the gas line before it reaches gas inlet 1223. In accordance with this embodiment, the inside diameter of alignment cuff 1526 is equal to the outer diameter of gas line 1505, allowing for self-centering as gas line 105 passes through gas alignment brace.

According to certain embodiments, gas line 105 may be secured to gas alignment brace 1500 via epoxy or other adhesives. According to other embodiments, gas line 105 may be secured to gas line alignment brace 1500 via grommets or other mounts. Gas alignment brace 1500 may be secured to the novelty apparatus via brackets 1527, for example via brackets 1527 attaching to top frame rail 1018.

Figure 16:
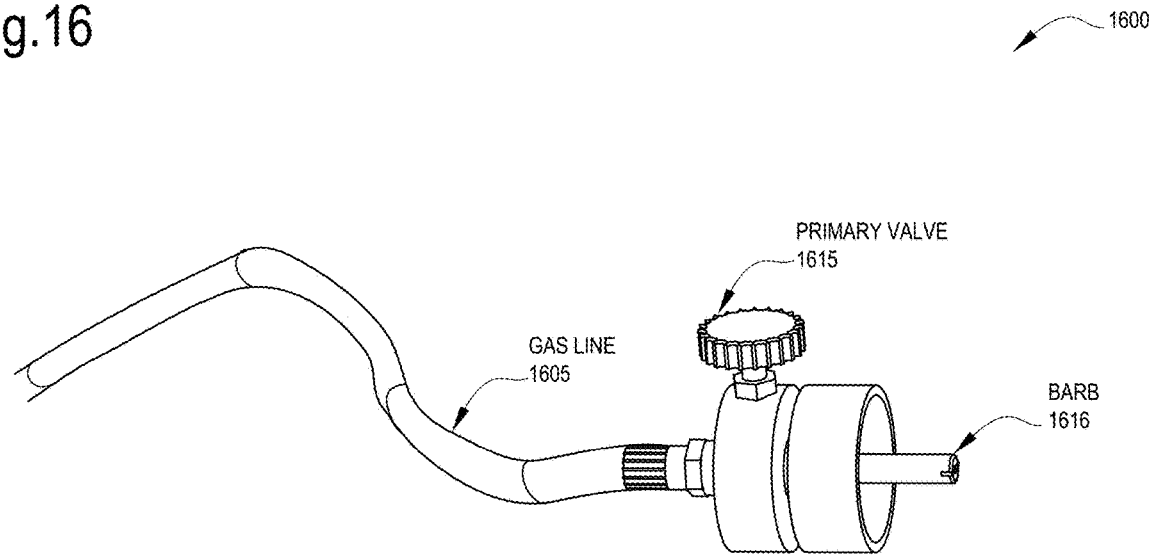
FIG. 16 depicts a side view of an exemplary gas line and its connections, in accordance with described embodiments.

FIG. 16 depicts a side view of an exemplary gas line and its connections, in accordance with described embodiments.

As shown here, barb 1616 of gas line 1605 connects to a fuel source tank. Upon opening of primary valve 1615, gas flows through barb 1616 into gas line 1605, which may be connected at its other end to gas inlet 1223.

Figure 17:
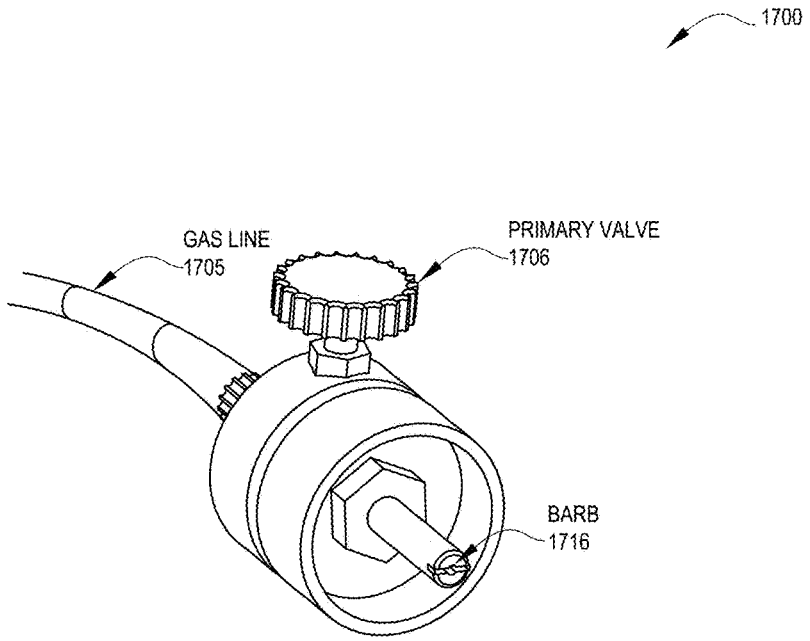
FIG. 17 depicts a perspective view of an exemplary gas line, in accordance with described embodiments.

FIG. 17 depicts a perspective view of an exemplary gas line, in accordance with described embodiments.

As shown here, barb 1716 of gas line 1705 connects to a fuel source tank. Upon opening of primary valve 1706, gas flows through barb 1716 into gas line 1705, which may be connected at its other end to gas inlet 1223.

Figure 18:
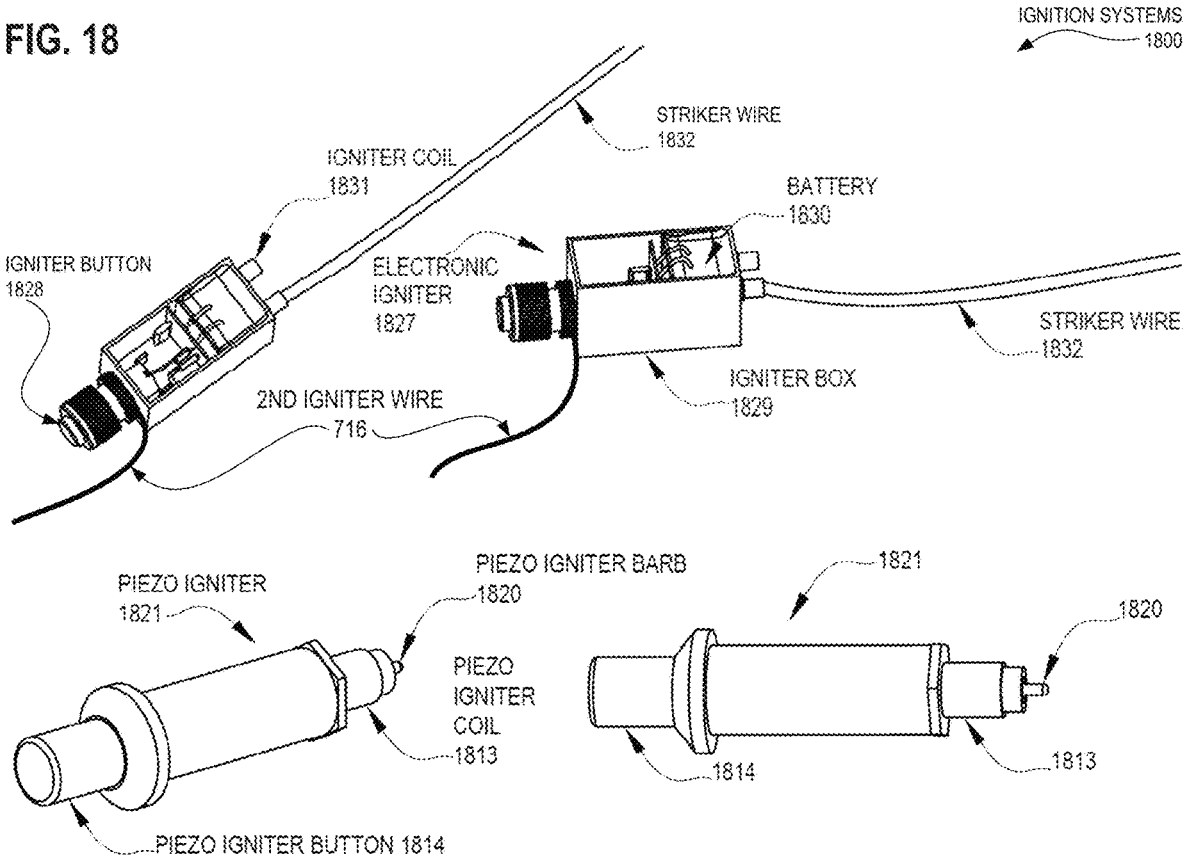
FIG. 18 depicts a perspective view of exemplary electronic and Piezo ignition systems, in accordance with described embodiments.

FIG. 18 depicts a perspective view of exemplary electronic and Piezo ignition systems, in accordance with described embodiments.

According to certain embodiments the ignition system of novelty apparatus 100 may be electronic instead of using piezoelectricity which involves the creation of voltage and release of electrical discharge on materials such as crystal deformed under high pressure, such as when struck with a spring-loaded hammer.

As shown here, ignition systems 1800 may include, for example, electronic igniter 1827 or Piezo igniter 1821.

Electronic igniter 1827 is comprised of igniter button 1828 which activates battery 1830 housed in igniter box 1829. Electric discharge from battery 1830 is transferred to igniter coils 1831 which in turn flows through striker wire 1832. In certain embodiments striker wire 1832 may connect via connectors to a second wire, for example, an output wire, which in turn may connect to a flame output system such as flame output system 1200. Thus, output wires may be attached to the downstream end of various ignition systems used with novelty apparatus 100 in order to complete an ignition circuit between an electronic or non-electronic igniter, striker wire and flame output system 1200.

According to certain embodiments, the ignition system for novelty apparatus 100 is non-electronic and is instead based on piezoelectric principles. Shown here is Piezo igniter 1821 with Piezo igniter button 1814, Piezo igniter coil 1813, and Piezo igniter barb 1820. Piezoelectricity involves the creation of voltage and release of electrical discharge on materials such as crystal deformed under high pressure, such as when struck with a spring-loaded hammer. Thus, in certain embodiments, igniter button 1814 activates a spring-loaded hammer mechanism which strikes a crystal within Piezo igniter 1821, releasing electric discharge which passes through Piezo igniter coil 1813, Piezo igniter barb 1820 and through wires to conduct the electrical discharge into flame output system 1200 and specifically, burner tube 1211 in order to ignite flowing gas to generate flame.

Piezo igniter 1821 may be mounted, for example into bottom frame 202 using an igniter mount to provide stability and easy access for users to ignite gas flowing through novelty apparatus 100 via igniter button 1814. Likewise, electronic igniter 1827 may also be mounted in the same manner.

Figure 19:
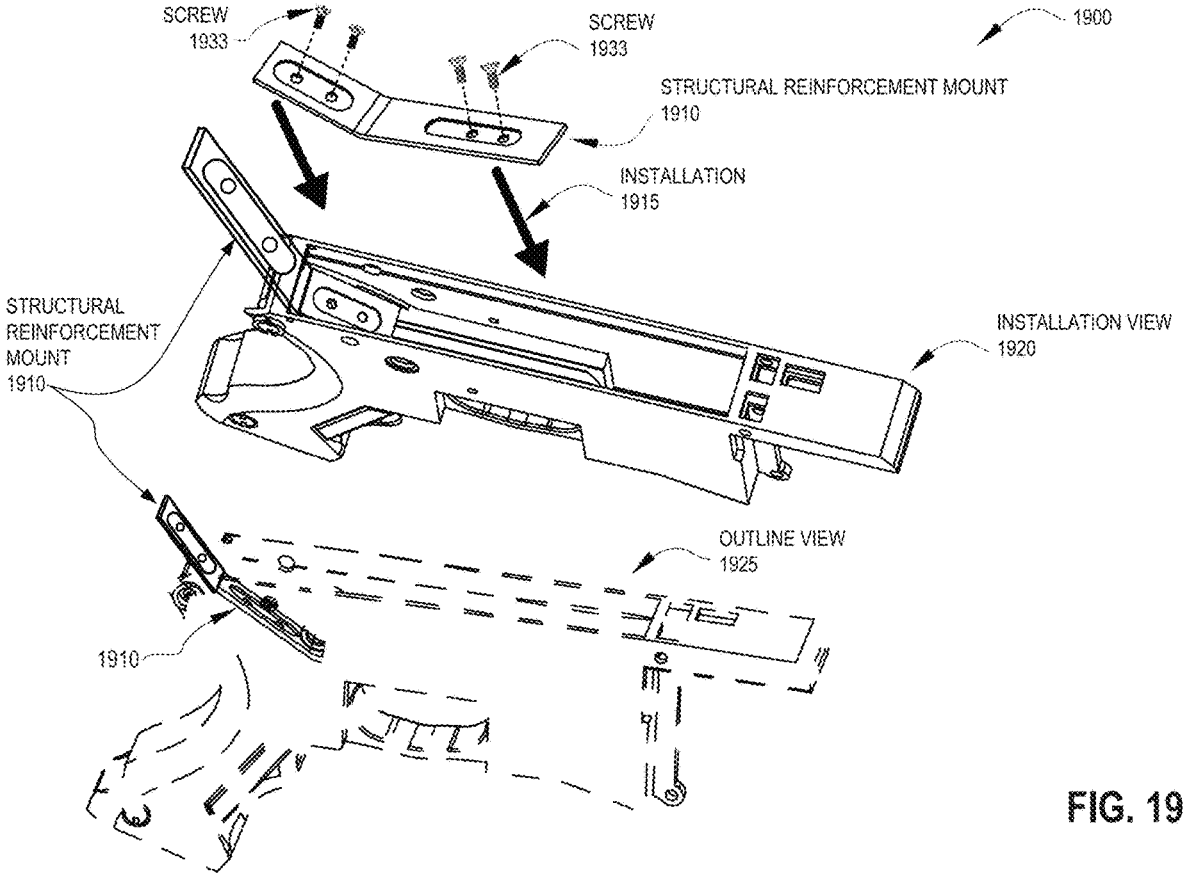
FIG. 19 depicts an exemplary structural reinforcement mount and assembled views, in accordance with described embodiments.

FIG. 19 depicts an exemplary structural reinforcement mount and assembled views, in accordance with described embodiments.

As shown here, structural reinforcement mount 1910 is an L-shaped or obtuse-angled bracket contoured to support interfaces between bottom frame 102 and various regions of a novelty apparatus such as a tactical mount region and a region for flame output system 1200. Holes within structural reinforcement mount 1910 allow for the attachment of mounting via mounting screws 1933 or bolts or other fastening means.

To provide structural support and to avoid damage and breaking to various portions of novel apparatus 100 during shipping or use, such as tactical stock 107, additional structural integrity may be added by the installation 1915 of one or more structural reinforcement mounts 1910 connecting various portions of novel apparatus 100.

For example, according to one embodiment, installation view 1920 illustrates a top perspective view of structural reinforcement mount 1910 housed within bottom frame 102, reinforcing the connection between an interface region for tactical stock 107 and top frame 101. Outline view 1925 illustrates a transparent side view of structural reinforcement bracket 1910 in the posterior region of novelty apparatus 100. According to certain embodiments, structural reinforcement mount 1910 may be used to secure other regions of novelty apparatus 100, such as regions adjacent to flame output system 1200, output nozzle 112, or at the interface between top frame 101 and bottom frame 102.

Figure 20:
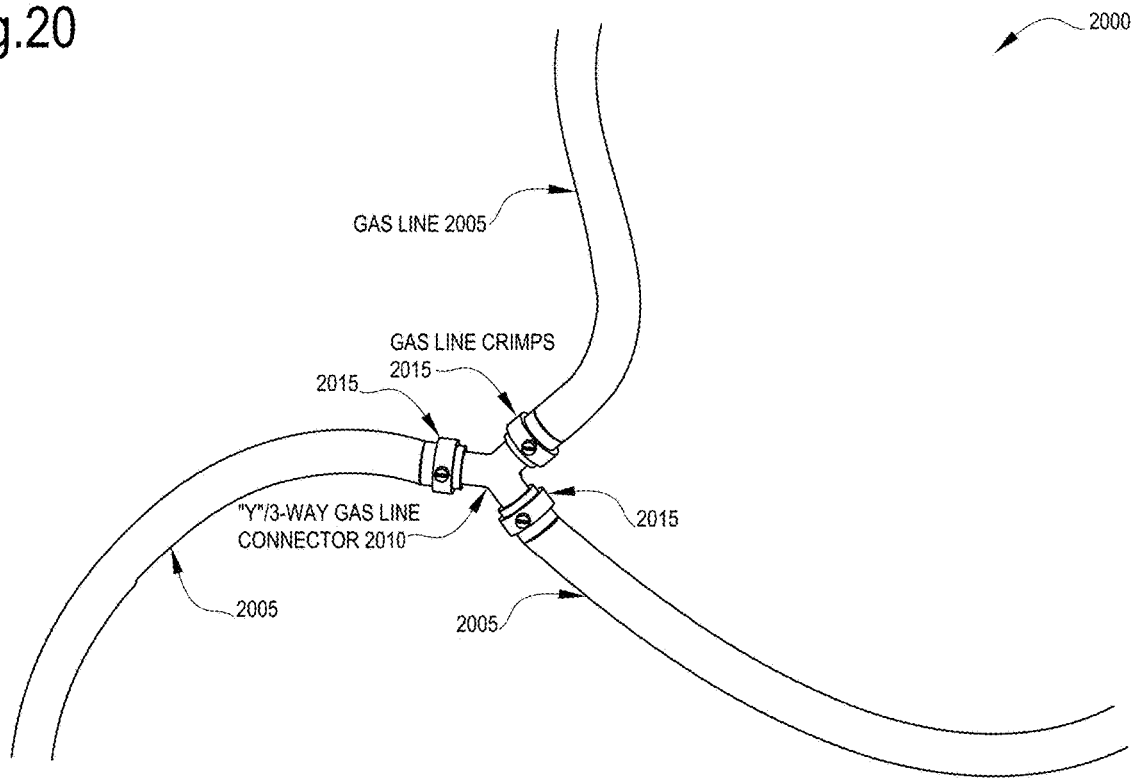
FIG. 20 depicts an exemplary "Y"/3-way gas line connector and associated gas lines, in accordance with described embodiments.

FIG. 20 depicts an exemplary "Y"/3-way gas line connector and associated gas lines, in accordance with described embodiments.

An important feature of a novelty apparatus in some embodiments is the ability to attach multiple fuel source tanks, which in turn require multiple gas lines such as gas lines 2005, connected for example, via "Y"/3-way gas line connector 2010 and secured by gas line crimps 2015 or other attachment means such as clasps, barbs, threaded connectors, etc. Multiple fuel source tanks may be mounted via multiple tank mounts attached to a novelty apparatus such as novelty apparatus 100 on top of top frame 101 or hanging from bottom frame 102 via attachments on tactical rails or Picatinny rails along these frames. "Y"/3-way gas line connector 2010 allows for the transit of gas from multiple fuel source tanks via gas lines 2005 towards a gas inlet of a flame output system such as flame output system 1200. This in turn allows a novelty apparatus such as novelty apparatus 100 to emit a long lasting flame, as well as larger flame bursts when activation of trigger 1233 ignites the gas passing through flame output system 1200.

Figure 21:
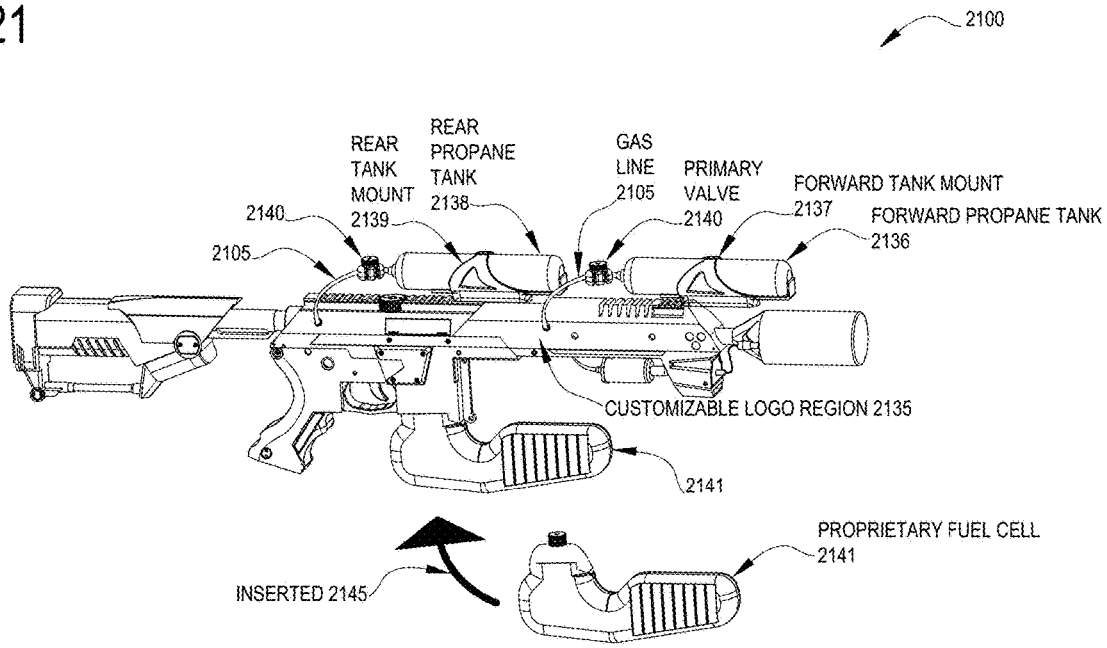
FIG. 21 depicts an exemplary device with variable flame control and multiple fuel source tanks, in accordance with described embodiments.

FIG. 21 depicts an exemplary device with variable flame control and multiple fuel source tanks, in accordance with described embodiments.

As shown here, in certain embodiments, the novelty apparatus may have multiple fuel source tanks attached. According to certain embodiments, each attached fuel source tank may require a tank mount and gas line. Mounting of multiple fuel source tanks in such embodiments of a novelty apparatus also makes for an impressive display to amaze viewers. For example, forward propane tank 2136 rests on forward tank mount 2137 in the anterior region of the novelty apparatus. Primary valve 2140 controls the flow of gas from forward propane tank 2136. Posteriorly, rear propane tank 2138 rests on rear tank mount 2139. In certain embodiments, the gas contained in the tanks may be propane and in other embodiments other type of gas as suitable may be used. Gas lines 2105 connect forward propane tank 2136 and rear propane tank 2138 to flame output systems such as flame output system 1200. In certain embodiments, gas lines 2105 may be connected via a gas line connector such as a "Y"/3-way gas line connector 2010. Additionally, users may desire to add a logo to the frame or other region of the novelty apparatus, for example a logo advertising their business, web domain or for artistic expression. Customizable logo region 2135 illustrates one such region on the novelty apparatus where a logo may be added. As shown here, customizable logo region 2135 is located on the anterior medial region a top frame such as top frame 101.

An especially unique feature of certain embodiment of novelty apparatus 100 is proprietary fuel cell 2141. According to certain embodiments, proprietary fuel cell 2141 may have a proprietary shape or appearance, such as that of an engine block, submarine, fist, bellows or sneaker. Proprietary fuel cell 2141 may serve as a primary or add-on fuel source and may be inserted 2145 into a specially designed receive port on the novelty apparatus, for example anterior to trigger 213. Proprietary fuel cell 2141 may, for example, be an additive fuel source to increase the intensity or length of the emitted flame from the novelty apparatus. For example, proprietary fuel cell 2141 may inject nitrous oxide or oxygen into flame output system 1200 to make the emitted flame burn hotter through increased combustion. Nitrous oxide, for example, chills the air in the novelty apparatus, making the air denser and increasing its oxygen by volume. Thus, more oxygen is available to make the emitted flame burn more intensely. According to certain embodiments, proprietary fuel cell 2141 may be a high-pressure fuel cell, able to withstand a greater pressure of gases contained within the cell and injected into flame output system 1200 of the novelty apparatus, resulting in more efficient flame combustion and a greater distance of flame emission.

Through these mechanisms, proprietary fuel cell 2141 increases the energy efficiency of the novelty apparatus as well as avoiding emission of byproducts harmful to the environment as occurs with traditional combustion mechanisms.

According to certain embodiments, proprietary fuel cell 2141 may contain material to emit flames of a certain color, with different proprietary fuel cells 2141 each containing material to emit a different flame color when used with the novelty apparatus. For example, proprietary fuel cell 2141 may contain metals or metal salts, which are compounds containing metal and non-metal atoms, which produce intense colors when burned. Heat energy from the emitted flame excites electrons in these compounds to a higher quantum level and the atoms emit the colors via emitting photons with energies corresponding to portions of the visible spectrum for a certain color as they return to lower energy levels.

According to one embodiment, proprietary fuel cell 2141 may contain strontium salts such as strontium nitrate, strontium carbonate and strontium sulfate to emit a reddish color. According to another embodiment, proprietary fuel cell 2141 may contain calcium salts such as calcium carbonate, calcium chloride and calcium sulfate to emit an orange-like color. According to another embodiment, proprietary fuel cell 2141 may contain sodium salts such as sodium nitrate, sodium oxalate and calcium sulfate to emit an orange-like color. According to another embodiment, proprietary fuel cell 2141 may contain sodium borate or barium salts such as barium nitrate, barium carbonate and barium chlorate to emit a greenish color. According to another embodiment, proprietary fuel cell 2141 may contain copper salts such as copper (I) chloride, copper carbonate and copper oxide to emit a bluish color. According to another embodiment, proprietary fuel cell 2141 may contain combinations of strontium and copper compounds to emit a purplish color. According to another embodiment, proprietary fuel cell 2141 may contain metals such as magnesium, aluminum, and titanium to emit whitish or silvery colors. Thus, having various flame color options increases the display and amusement possibilities of novelty apparatus and may be used to complement or match the colors of user(s) clothing or backgrounds. It should be noted that some of these compounds may be toxic or environmentally hazardous.

Figure 22:
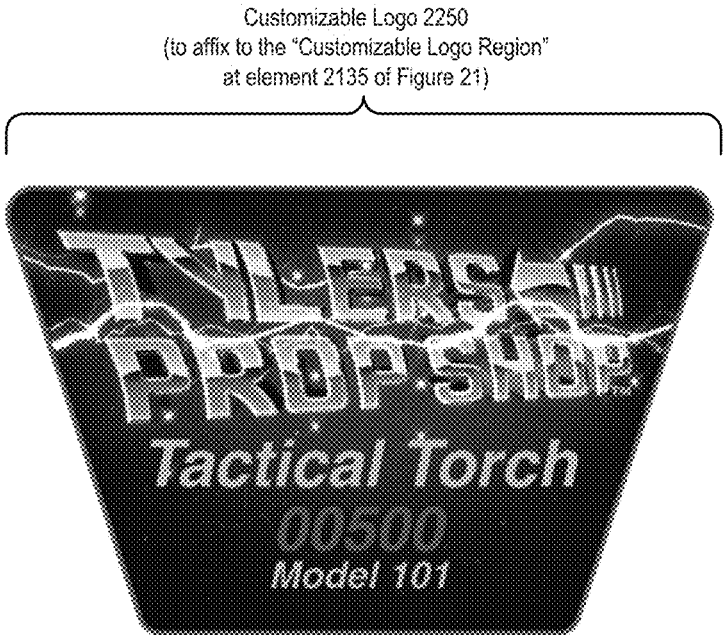
FIG. 22 depicts an exemplary customizable logo, in accordance with described embodiments.

FIG. 22 depicts an exemplary customizable logo 2250, in accordance with described embodiments.

For instance, as shown here, a customizable logo 2250 plate, sticker, or other logo attachment may be affixed to the apparatus at the location depicted by element 2135 of FIG. 21. The customizable logo 2250 plate may include information such as a serial number, a model number, a license number, etc., in addition to the logo itself.

Further customization is permissible for the apparatus. For instance, the entire apparatus may be colored via dyed plastics, or painted, or covered in a decorative film, so as to make the apparatus more distinctive according to the level of customization desired.

Further still, customized output nozzles are configurable for the apparatus, such as a dragon's head shaped fixture to be positioned over the output nozzle (e.g., see FIG. 7 at element 712) which will permit still further distinctiveness. Other attachments are permissible, according to the customization and design specified, so long as the attachment is positionable over the output nozzle in a way that does not obstruct the egress of gas and flames from the nozzle and which does not disrupt the idle flame or the ignition systems (e.g., see FIG. 18 at element 1800).

Figure 23A:
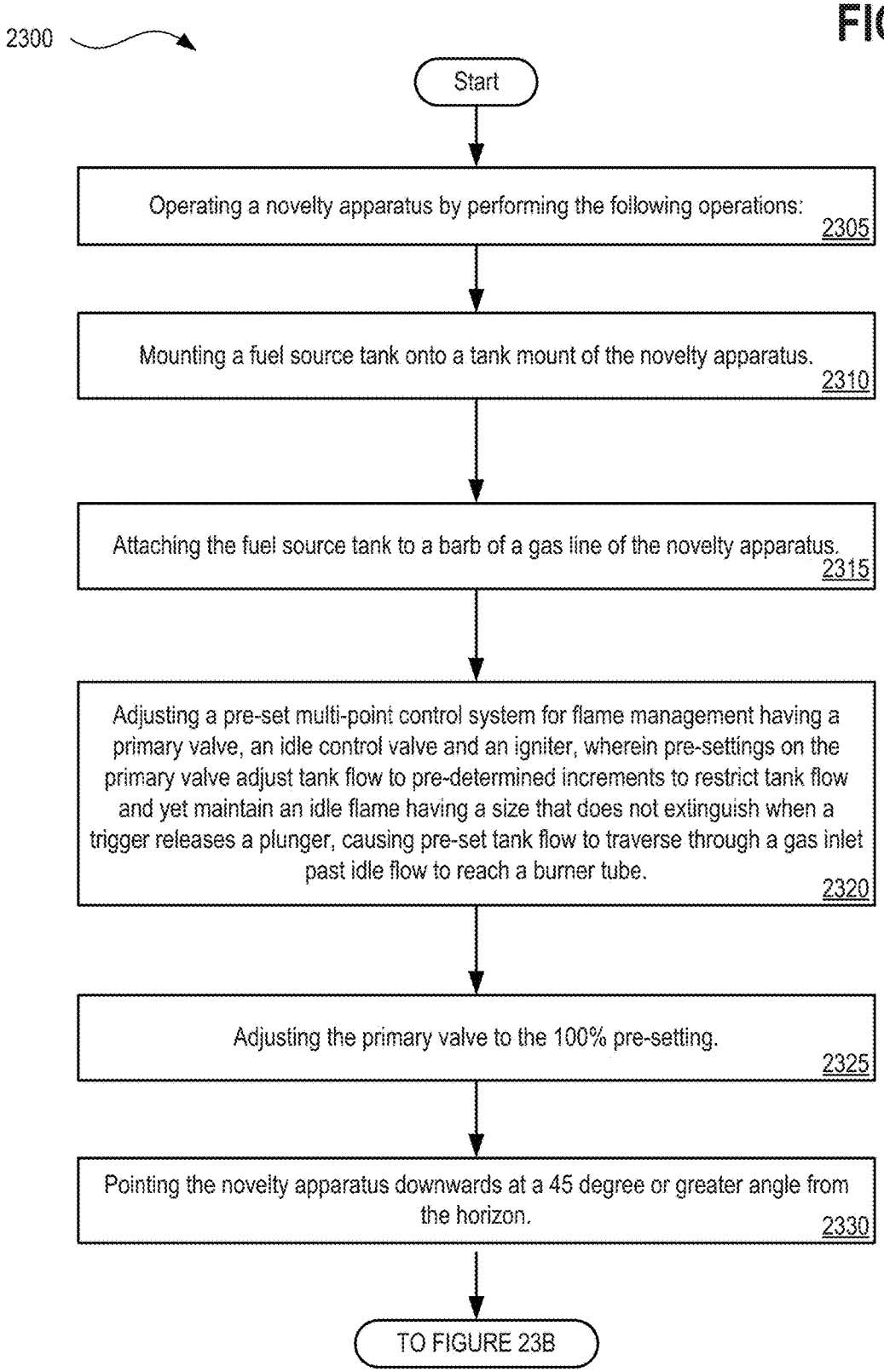
FIGS. 23A and 23B depict a flow diagram illustrating a method for operating a novelty apparatus having multi-point controls for a gas flame with a variable position gas flame trigger, in accordance with disclosed embodiments.
Figure 23B:
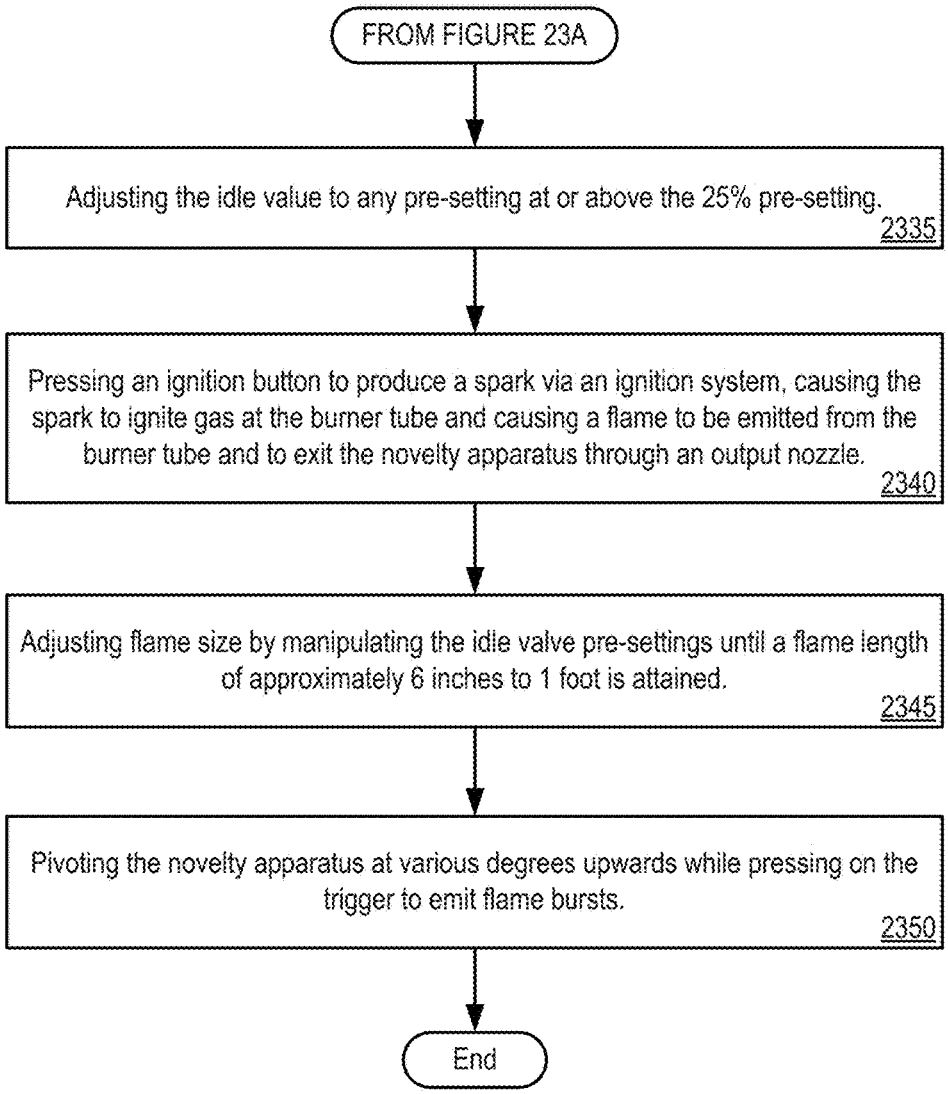

FIGS. 23A and 23B depict a flow diagram illustrating a method 2300 for operating a novelty apparatus having multi-point controls for a gas flame with a variable position gas flame trigger, in accordance with disclosed embodiments.

Some of the blocks and/or operations listed below are optional in accordance with certain embodiments. The numbering of the blocks presented is for the sake of clarity and is not intended to prescribe an order of operations in which the various blocks must occur.

With reference to the method 2300 depicted at FIG. 23A beginning at block 2305, there is a method for operating a novelty apparatus by performing the following operations:

At block 2310, the method includes mounting a fuel source tank onto a tank mount of the novelty apparatus.

At block 2315, the method includes attaching the fuel source tank to a barb of a gas line of the novelty apparatus.

At block 2320, the method includes adjusting a pre-set multi-point control system for flame management having a primary valve, an idle control valve and an igniter, wherein pre-settings on the primary valve adjust tank flow to predetermined increments to restrict tank flow and yet maintain an idle flame having a size that does not extinguish when a trigger releases a plunger, causing pre-set tank flow to traverse through a gas inlet past idle flow to reach a burner tube.

At block 2325, the method includes adjusting the primary valve to a 100% pre-setting.

At block 2330, the method includes pointing the novelty apparatus downwards at a 45 degree or greater angle from the horizon.

The method 2300 continues at FIG. 23B, continuing with block 2335, wherein the method further includes adjusting the idle value to any pre-setting at or above the 25% pre-setting.

At block 2340, the method includes pressing an ignition button to produce a spark via an ignition system, causing the spark to ignite gas at the burner tube and causing a flame to be emitted from the burner tube and to exit the novelty apparatus through an output nozzle.

At block 2345, the method includes adjusting flame size by manipulating the idle valve pre-settings until a flame length of approximately 6 inches to 1 foot is attained.

At block 2350, the method includes pivoting the novelty apparatus at various degrees upwards while pressing on the trigger to emit flame bursts.

According to another embodiment of method 2300, the pre-settings on the primary valve are configurable to adjust the tank flow at 25%, 50%, 75% and 100% increments and pre-settings on the idle control valve adjust idle flow at 25%, 50%, 75% and 100% increments, to restrict tank flow.

According to another embodiment of method 2300, the grip affixed to the frame is positioned as a first grip and positioned to serve as a pistol grip; a second grip is affixed to the frame and is positioned anteriorly to serve as a foregrip; and a tank mount is optionally affixed to second grip in an anterior position of the frame relative to the pistol grip.

According to another embodiment of method 2300, rails are affixed to a portion of the frame; and the rails are selected from a single type or combination of the following types of rails: (i) a Picatinny rail, (ii) a tactical rail, and (iii) a proprietary form factor rail.

According to another embodiment of method 2300, one or more tank mounts may be affixed to the rails, wherein the tank mounts receive fuel source tanks with gas lines, wherein the gas lines are connected via a gas line connector.

According to another embodiment of method 2300, the ignition system is one of the following: (i) an electronic ignition system with a battery, or (ii) a piezoelectric ignition system with a Piezo igniter.

According to another embodiment of method 2300, a customizable logo region on the frame receives text and graphics as determined by the user or manufacturer.

According to another embodiment of method 2300, tank flow is pre-set at 100%, idle flow is set at 75%, and pressing the trigger releases 100% of the 75% tank flow to the burner tube.

None of the claims are intended to invoke paragraph six of 35 U.S.C. § 112 unless the exact words "means for" are followed by a participle. While the subject matter disclosed herein has been described by way of example and in terms of the specific embodiments, it is to be understood that the claimed embodiments are not limited to the explicitly enumerated embodiments disclosed. To the contrary, the disclosure is intended to cover various modifications and similar arrangements as are apparent to those skilled in the art. Therefore, the scope of the appended claims are to be accorded the broadest interpretation so as to encompass all such modifications and similar arrangements. It is to be understood that the above description is intended to be illustrative, and not restrictive. Many other embodiments will be apparent to those of skill in the art upon reading and understanding the above description. The scope of the disclosed subject matter is therefore to be determined in reference to the appended claims, along with the full scope of equivalents to which such claims are entitled.

What is claimed is:

1. A novelty apparatus, comprising:

a frame, wherein the frame is comprised of a top frame resting upon a bottom frame;

an output nozzle anterior to the frame;

a tactical stock posterior to the frame;

a tank mount attached to the frame to receive a fuel source tank;

a gas line to feed gas from the fuel source tank into a gas inlet of the novelty apparatus;

a grip affixed to the frame;

a flame output system housed within the frame, wherein the flame output system includes at least (i) the gas inlet to receive the gas line, (ii) a variable control plunger, (iii) a 4-way connector, (iv) a gas outlet, (v) a gas hard-line, and (vi) a burner tube;

a trigger housed in the frame connected to the variable control plunger, wherein pressing on the trigger releases the plunger to feed gas into the gas inlet from the gas line;

an ignition system, wherein the ignition system includes at least (i) an igniter button, (ii) an igniter, (iii) igniter coils, and (iv) an igniter wire;

a pre-set multi-point control system for flame management having a primary valve, an idle control valve and an igniter, wherein pre-settings on the primary valve adjust tank flow at pre-configured increments;

wherein adjusting the pre-settings on the multi-point control system maintains an idle flame having a size that does not extinguish when the trigger releases the plunger and a pre-set increment of tank flow is released, transiting the idle flow to reach the burner tube;

a structural reinforcement mount internal to the frame to provide rigidity and receive the tactical stock; and wherein manipulation of the multi-point control system in coordination with the flame output system and ignition system results in the emission and maintenance of a flame.

* * * * *